US010347090B2

(12) United States Patent
Berman

(10) Patent No.: US 10,347,090 B2
(45) Date of Patent: Jul. 9, 2019

(54) ICON SELECTION AND ACTIVATION IN GAMING DEVICES

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 398 days.

(21) Appl. No.: 14/574,587

(22) Filed: Dec. 18, 2014

(65) Prior Publication Data

US 2015/0206400 A1 Jul. 23, 2015

Related U.S. Application Data

(60) Provisional application No. 61/928,882, filed on Jan. 17, 2014.

(51) Int. Cl.
*G07F 17/32* (2006.01)
*G07F 17/34* (2006.01)

(52) U.S. Cl.
CPC ..... *G07F 17/34* (2013.01); *G07F 17/3211* (2013.01); *G07F 17/3258* (2013.01)

(58) Field of Classification Search
CPC ... G07F 17/32; G07F 17/3211; G07F 17/3213
See application file for complete search history.

(56) References Cited

U.S. PATENT DOCUMENTS 7,354,342 B2 * 4/2008 Paulsen ..... G07F 17/34 273/142 R
2008/0113760 A1 * 5/2008 Baerlocher ..... G07F 17/32 463/20
2009/0117993 A1 * 5/2009 Bigelow, Jr. ..... G07F 17/34 463/22
2011/0287823 A1 * 11/2011 Guinn ..... G07F 17/3258 463/19

* cited by examiner

*Primary Examiner* — James S. McClellan

(57) ABSTRACT

Embodiments of the present invention set forth systems, apparatuses and methods for the selection of a game icon and activation of the game icon in gaming devices. Accordingly, a gaming device can be configured to provide a selection process for features related to a gaming icon, as well as providing activation characteristics for the icon associated with received activation signals from player inputs. Here, upon receipt of a signal indicating an icon selection, a display is provided with multiple selectable features for the indicated icon. When a selection signal is received, the features of the indicated icon are updated to reflect the selected features associated with the selection signal. In addition, the activation and movement of the icon can be controlled by tracking player movement on a touch-screen display.

18 Claims, 13 Drawing Sheets

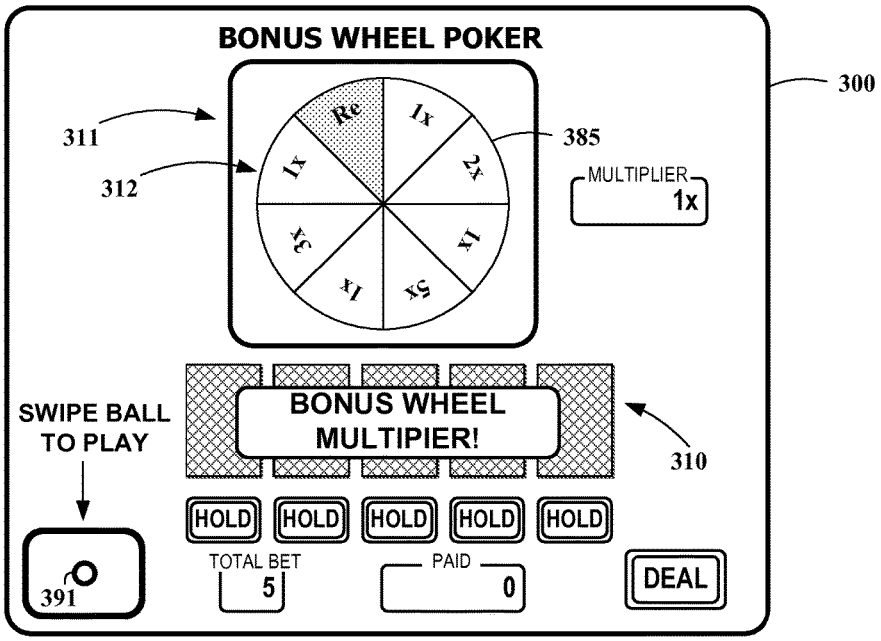
FIG. 3A
FIG. 3B
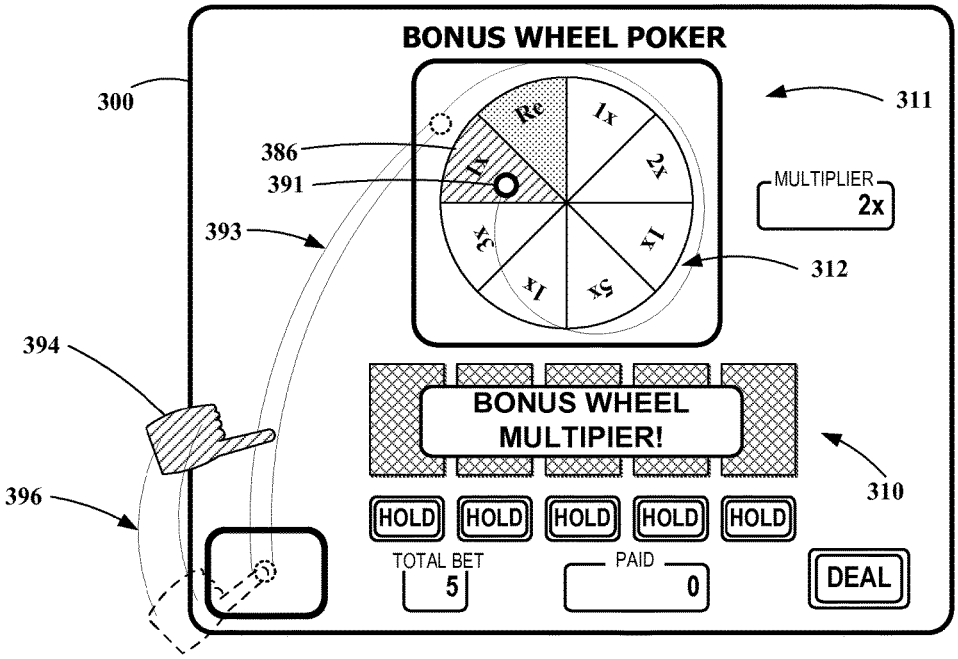

ICON SELECTION AND ACTIVATION IN GAMING DEVICES

RELATED APPLICATIONS

This application claims the benefit of Provisional Patent Application No. 61/928,882, filed on Jan. 17, 2014, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for the selection of a game icon and activation of the game icon in gaming devices.

BACKGROUND

Casino games such as poker, slots, and craps have long been enjoyed as a means of entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise facilitate the selection of a game icon and activation of the game icon in gaming devices. In one embodiment, a method of operating a gaming device includes providing an icon for player interaction, receiving an input signal to select a feature of the icon, displaying multiple possible features for the icon, receiving an input signal selecting at least one of the icon features, and updating the provided icon with the at least one selected feature. In other embodiments, a method of operating a gaming device includes receiving a signal indicating a player is touching an icon on a touchscreen display, tracking player touch movement on the touchscreen display, updating the position of the icon on the display to correspond to the tracked player movements, receiving a signal that the player has ceased touching the touchscreen display, calculating a velocity and trajectory based on the tracked player touch movements, and moving the icon across the display to a bonus area based on the calculated velocity and trajectory.

BRIEF DESCRIPTION OF THE DRAWINGS

FIGS. 3A and 3B are detail diagrams of another example game progression according to embodiments of the invention.

DETAILED DESCRIPTION

Figure 1:
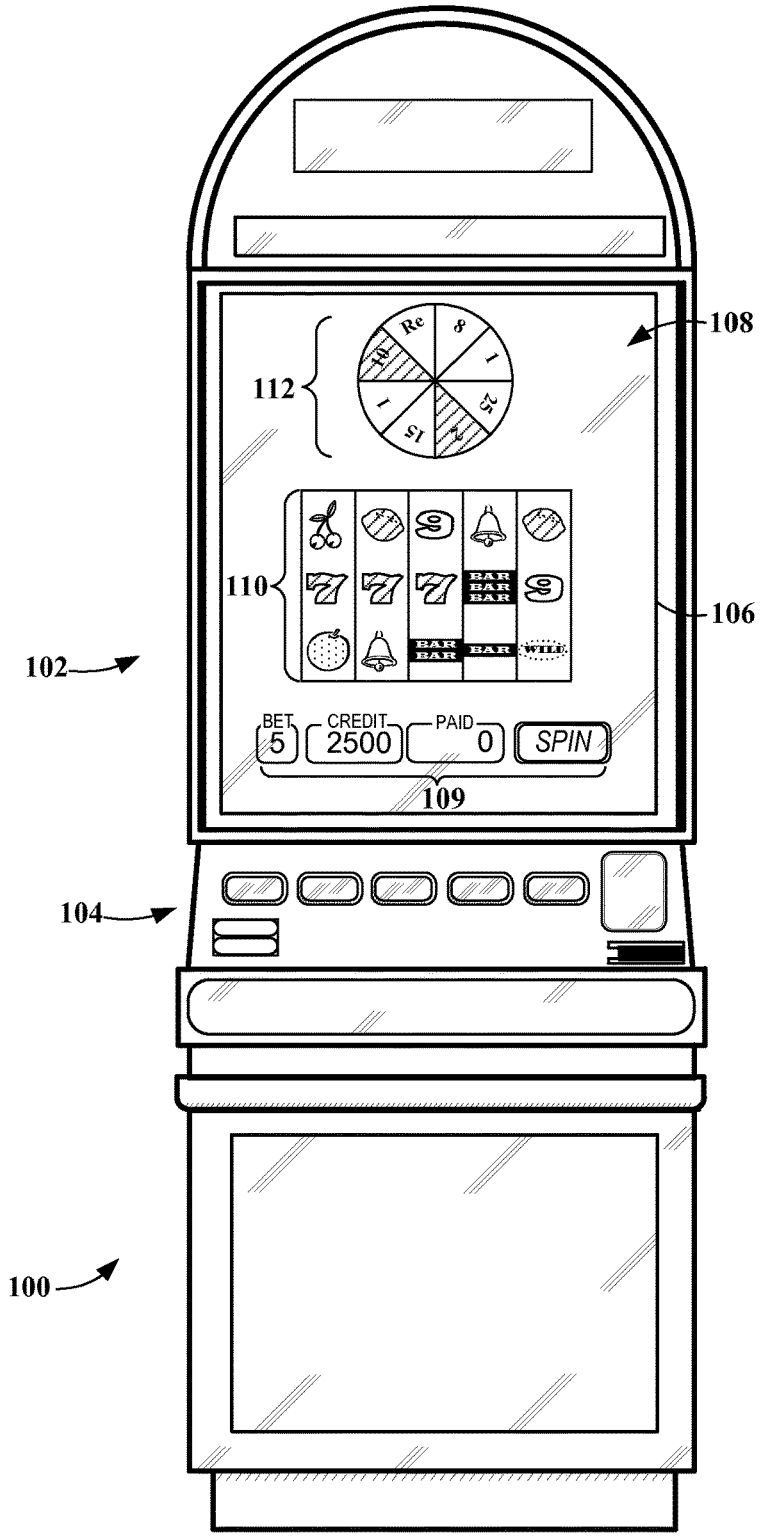
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the term "reels," "cards," "decks," and similar mechanically descriptive language may be used to describe various apparatus presentation features, as well as various actions occurring to those object (e.g., "spin," "draw," "hold," "bet"). Although the present disclosure may be applicable to manual, mechanical, and computerized embodiments, and any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing winning result opportunities in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot machine game) are provided for purposes of facilitating an understanding of the features described herein. However, the principles described herein are equally applicable to any game of chance where an outcome(s) is determined for use in the player's gaming activity. The game features described herein may be employed in stand-alone games, a primary/base games, bonus games, side bet games, etc.

Embodiments of the present concept include providing gaming devices (also referred to as gaming apparatuses or gaming machines), gaming systems, and methods of operating these devices or systems to provide game play that utilizes operations of the selection of a game icon and activation of the game icon in gaming devices. In one embodiment, a method of operating a gaming device includes providing an icon for player interaction, receiving an input signal to select a feature of the icon, displaying multiple possible features for the icon, receiving an input signal selecting at least one of the icon features, and updating the provided icon with the at least one selected feature. In other embodiments, a method of operating a gaming device includes receiving a signal indicating a player is touching an icon on a touchscreen display, tracking player touch movement on the touchscreen display, updating the position of the icon on the display to correspond to the tracked player movements, receiving a signal that the player has ceased touching the touchscreen display, calculating a velocity and trajectory based on the tracked player touch movements, and moving the icon across the display to a bonus area based on the calculated velocity and trajectory. Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve video poker or reel-based slot machine examples of this concept, other embodiments may include application of these inventive techniques in other types of poker games, slot games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display portion 102 (also referred to as a gaming display), and a player interface portion 104, although some or all of the user interface 104 may be provided via the display 102 in touchscreen embodiments. The display portion 102 may include one or more display areas 106 that may be included in physically separate displays or as portions of a common large display. Here, the game display 106 includes a game play portion 108 that displays game elements and symbols 110, a bonus portion 112, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The display device 102 may include one or more of an electronic display, a mechanical display, and a fixed display information, such as paytable information associated with a glass/plastic panel on the gaming machine 100. The symbols or other indicia associated with the play of the game may be presented on an electronic display device or on mechanical devices associated with a mechanical display. Generally, the display 102 devotes the largest portion of viewable area to the primary gaming portion 106. The gaming portion 106 is generally where the visual feedback for any selected game is provided to the user. The gaming portion 106 may render graphical objects such as cards, slot reels, dice, animated characters, and any other gaming visual known in the art. The gaming portion 106 also typically informs players of the outcome of any particular event, including whether the event resulted in a win or loss.

In some the example embodiments illustrated herein, the gaming portion 106 may display a grid 108 (or equivalent arrangement) of spinning reels used in a slot machine base game. In other embodiments, however, the gaming portion 106 may include one or more rows (or equivalent arrangements) of playing cards representing one or more poker hands. The bonus portion 112 may be located on a portion of the same physical display device 102 as shown in FIG. 1, or may be arranged on a separate display device (not shown). The bonus portion 112 may display elements of a bonus game, such as a bonus wheel, as shown in FIG. 1. In other embodiments, the bonus portion 112 may display various other types of bonus elements, bonus events, or features related to a bonus game.

The gaming portion 106 may include other features known in the art that facilitate gaming, such as status and control portion 109. As is generally known in the art, this portion 109 provides information about current bets, current wins, remaining credits, etc. associated with gaming activities of the grid 108. The control portion 109 may also provide touchscreen controls for facilitating game play. The grid 108 may also include touchscreen features, such as facilitating selection of individual cards for holding prior to draw of new cards and/or advancing particular cards to move up to the next hand if conditions are satisfied. The gaming portion 106 of the display 102 may include other features that are not shown, such as paytables, navigation controls, etc.

FIGS. 2A-2D illustrate an example game progression according to embodiments of the invention. These figures include a diagram of a gaming display 200 of a gaming device. The display 200 shown in this example progression has been simplified to focus on features of enhancing gaming experiences. For example, this progression may be part of a primary or base game, or may be part of a secondary or bonus event associated with a primary game that is not shown.

Referring to FIGS. 2A-2D, a game display 200 includes a win meter 206 showing a current award, a total meter 208 showing an aggregated award, and a user interface button 204 that may be used to facilitate play of the game. Here, the game display includes a game wheel 212 having multiple sections 280, 285. Here, some of the sections 280 include numerical values associated with win amounts, while other of the sections 285 relate to play features associated with the game wheel. A section indicator (or "icon") 290 is presented on the display 200, where the icon is configured to be activated and move to a section of the game wheel 212 to show a resulting section of the game wheel. In the game associated with this embodiment, a player activates the icon 290 or presses the interface button 204 to generate a random selection of a wheel section. A player may activate the icon 290 by placing a finger over it on the display 200 and swiping their finger to simulate throwing or rolling the icon 290. To facilitate this player activation, the game display may include a touchscreen display.

Figure 2A:
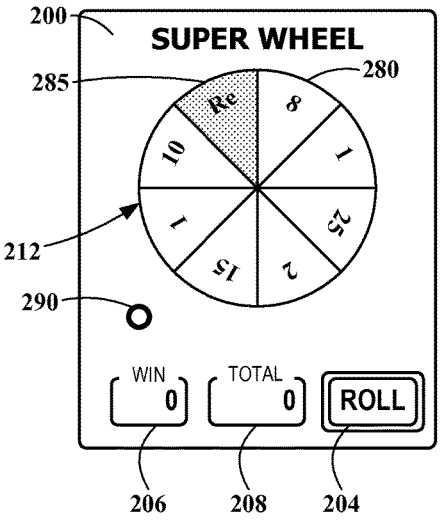
FIGS. 2A, 2B, 2C, and 2D are detail diagrams of an example game progression according to embodiments of the invention.
Figure 2B:
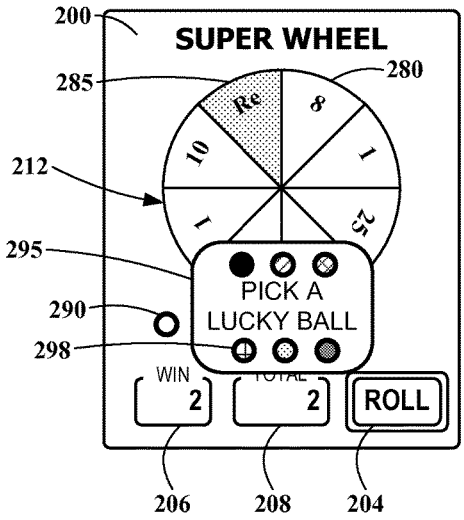

In this embodiment, the icon 290 is a circular ball object. However, in other embodiments, the icon may be any shape, type, or image style. In some embodiments of this invention, the player may be able to select features of the icon 290 to personalize it, or otherwise select features considered lucky. In the embodiment shown in these figures, the player may briefly touch the icon 290 to generate a feature-selection screen 295 (as shown in FIG. 2B) showing multiple possible features 298 for the icon. In this embodiment, the multiple possible features 298 relate to coloring, shading, images, or other appearance characteristics that can be applied to the icon 290. However, in other embodiments, feature selections 298 may include different sizes, shapes, associated sounds, graphics, animations, colors, styles, movement speeds, etc. of the icon 290. In some embodiments, the selectable features of the icon may relate to an overall theme of the icon, which may include multiple appearance and/or auditory characteristics.

Figure 2C:
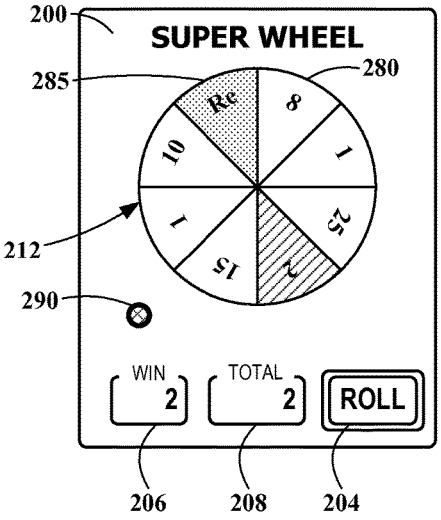
Figure 2D:
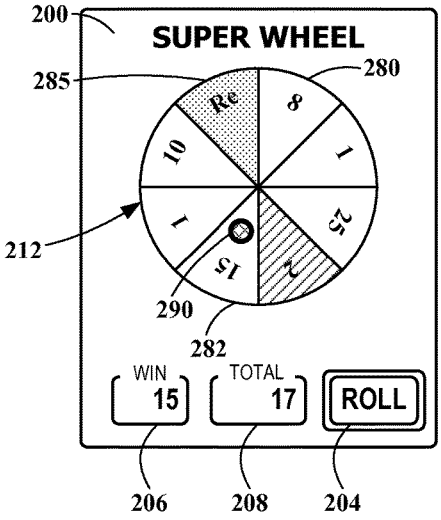

Once the player has selected a feature 298 in the feature-selection screen 295, the selected feature is applied to the icon 290, as shown in FIG. 2C. In some embodiments, multiple features may be selected for the icon 290 either in parallel with each other on the same selection screen 295, or in a series of selection screens 295. The icon 290 may then be activated as discussed above. The result of this activation is shown in FIG. 2D where the icon has come to rest in one of the sections 282 of the game wheel 212.

FIGS. 3A and 3B are detail diagrams of another example game progression according to embodiments of the invention. Referring to FIGS. 3A and 3B, a game display 300 includes a base game portion 310 and a bonus game portion 311. The base game portion 310 of this embodiment includes a draw poker game with five playing cards. The bonus game portion 311 of this embodiment includes a bonus wheel 312 with a number of sections 385 each having an associated multiplier value. An icon 391 is provided on the display 300, where the player can "swipe" or otherwise direct the icon 391 into the bonus game portion 311 of the display to mark one or more sections 285 of the bonus wheel 312.

As shown in FIG. 3B, a player can "swipe" or activate the icon 391 by touching the icon and moving his or her finger 394 along the display 300 in a direction 396 to move the icon in that direction. Once the player releases the icon 391 by removing his or her finger 394 from the display 300, the icon travels along a calculated trajectory or path 393 related to the movement direction 396 of the player's finger to the bonus game portion 311 of the display, where it travels to and marks a resulting section 386 of the bonus wheel 312.

FIGS. 4A, 4B, 4C, 4D, 4E, 4F, and 4G are detail diagrams of a game display showing another example game progression according to embodiments of the invention.

Figure 4A:
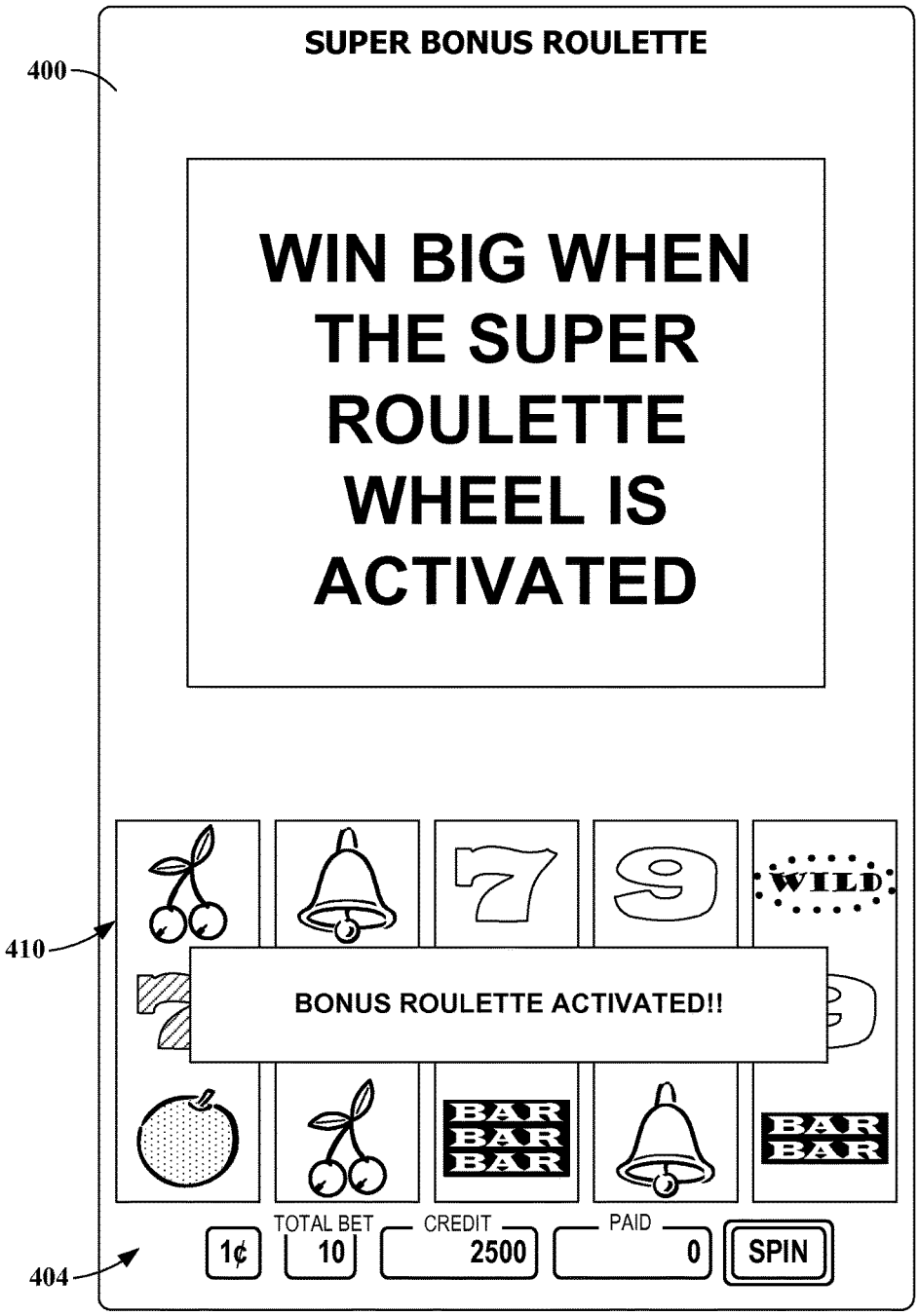
FIGS. 4A, 4B, 4C, 4D, 4E, 4F, and 4G are detail diagrams of a game display showing another example game progression according to embodiments of the invention.
Figure 4B:
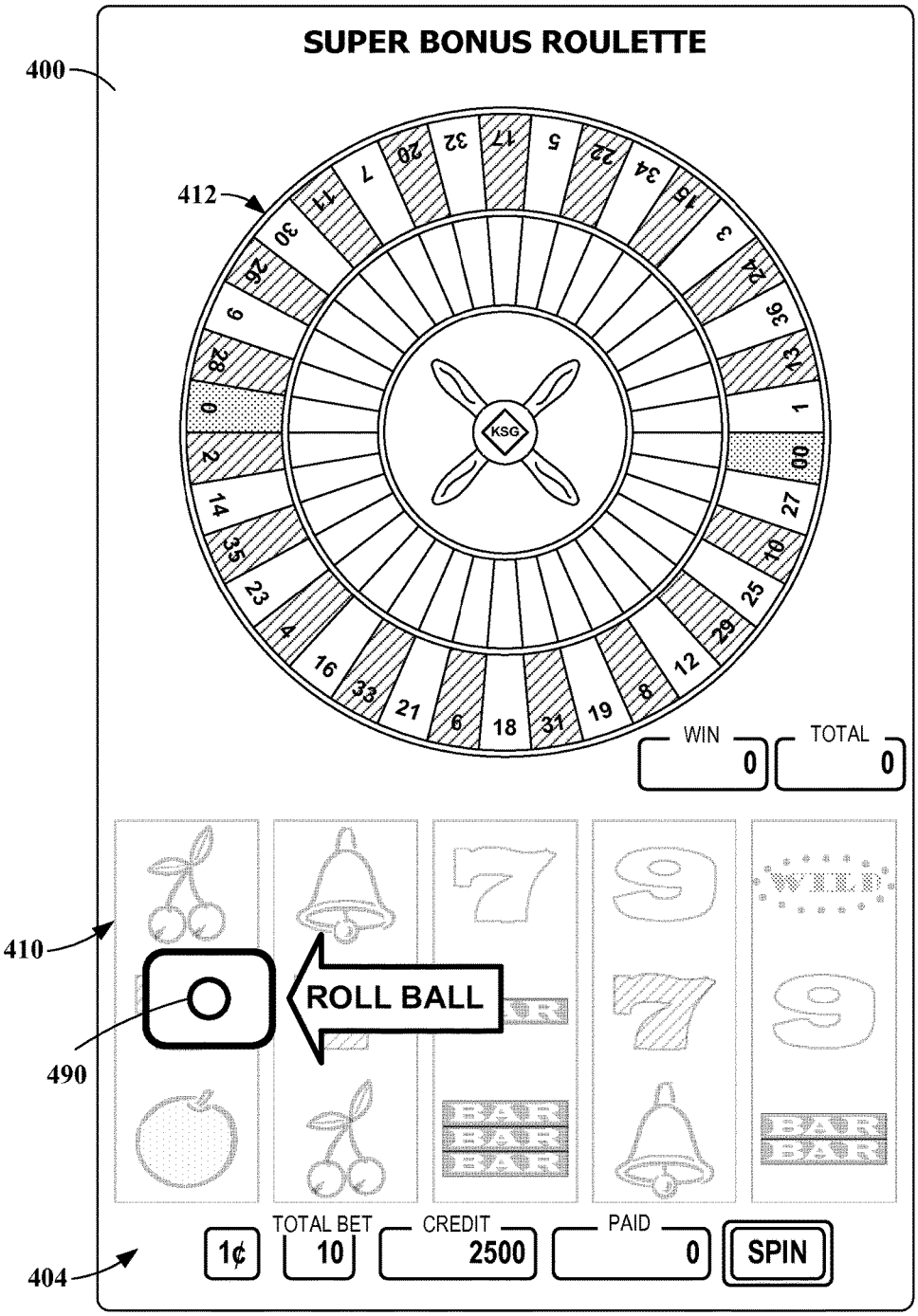
Figure 4C:
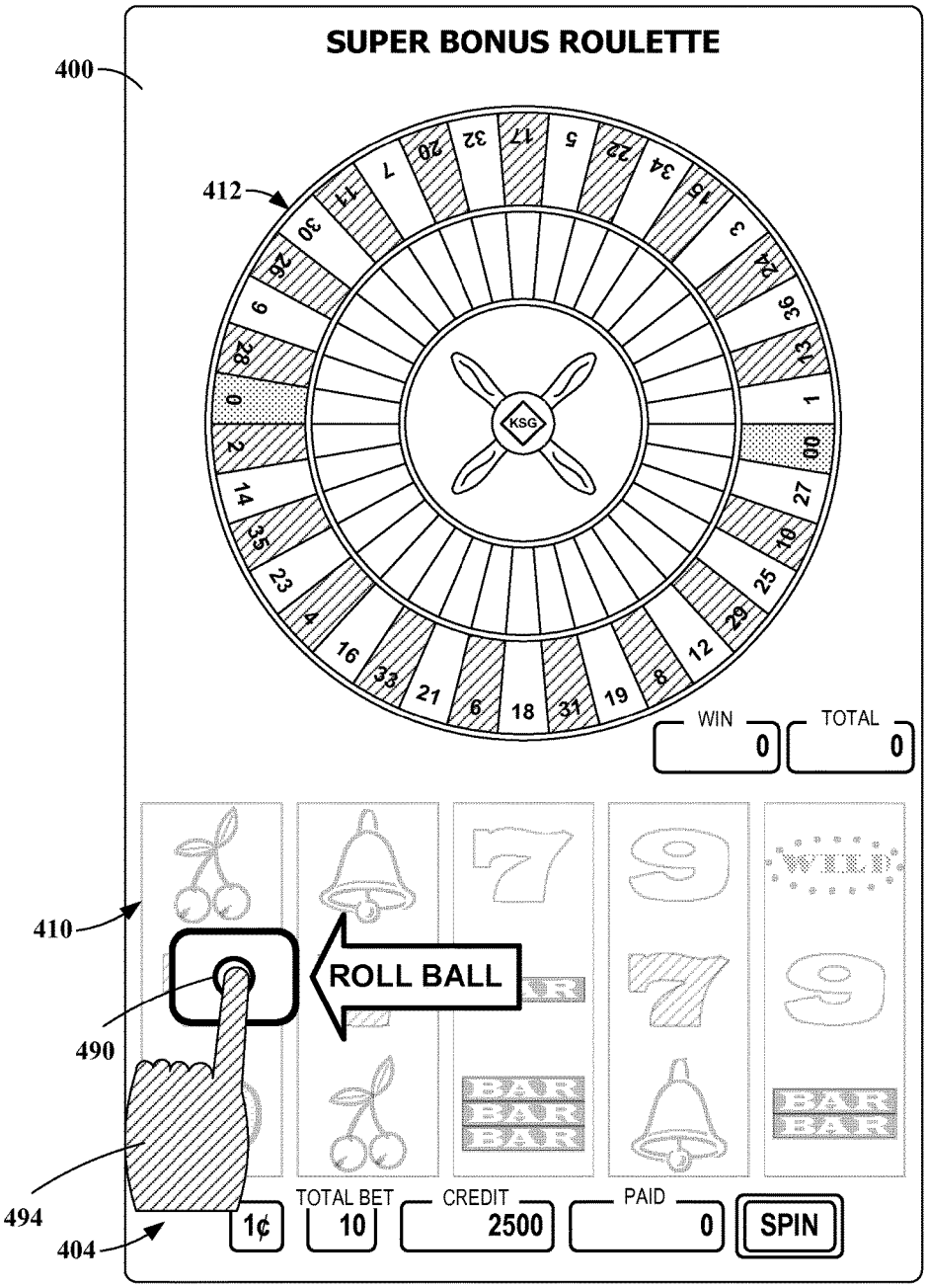
Figure 4D:
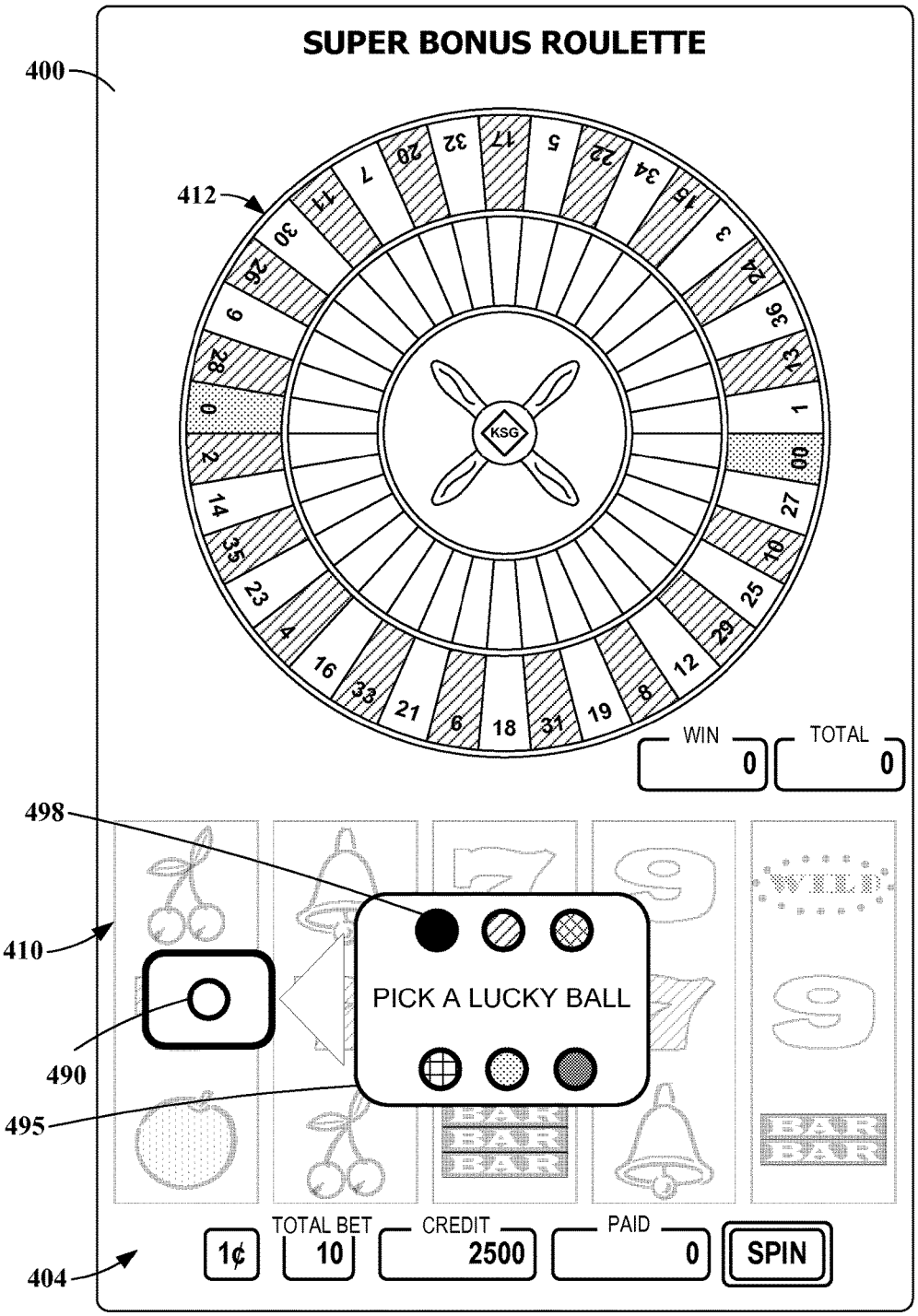
Figure 4E:
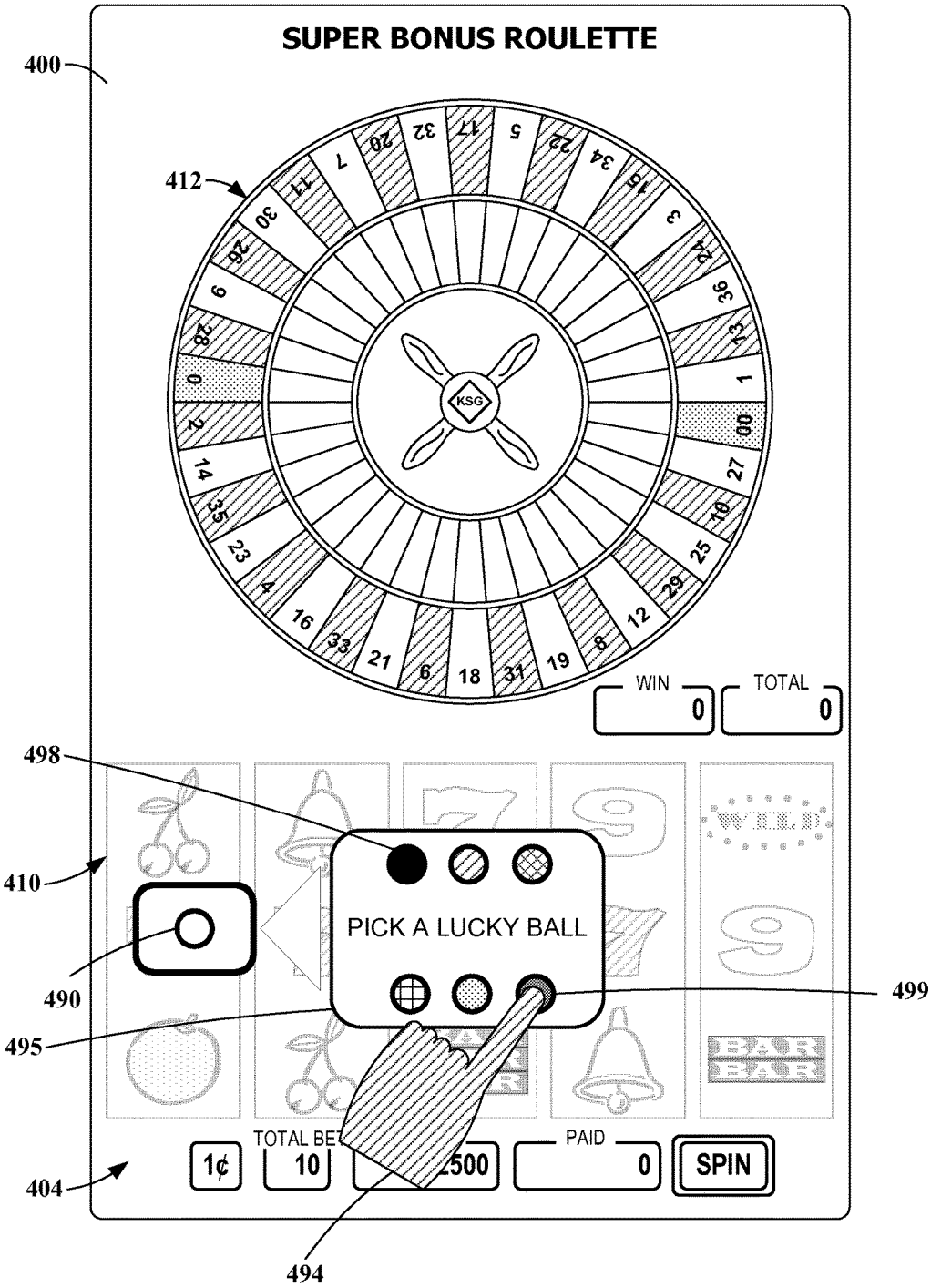
Figure 4F:
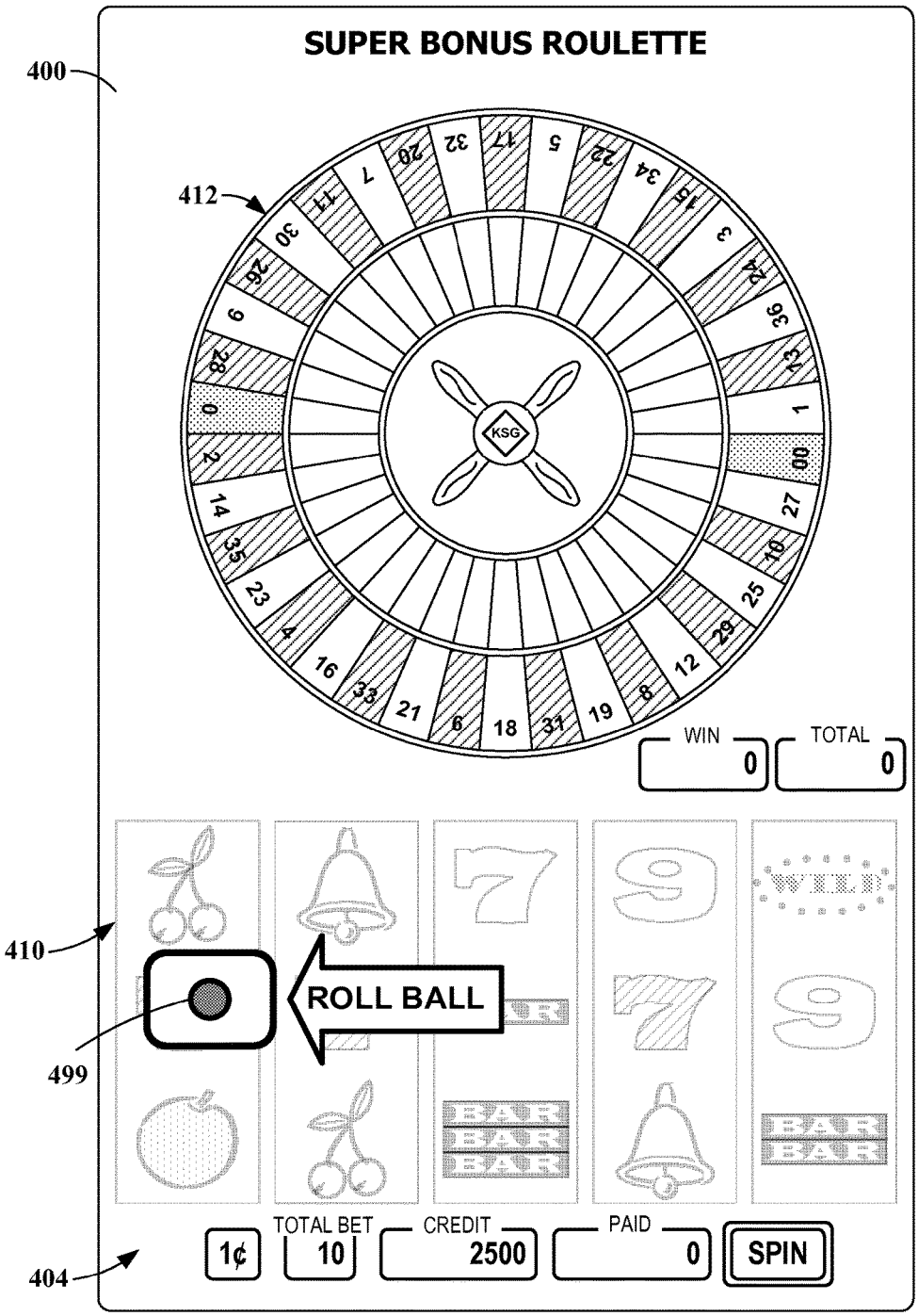
Figure 4G:
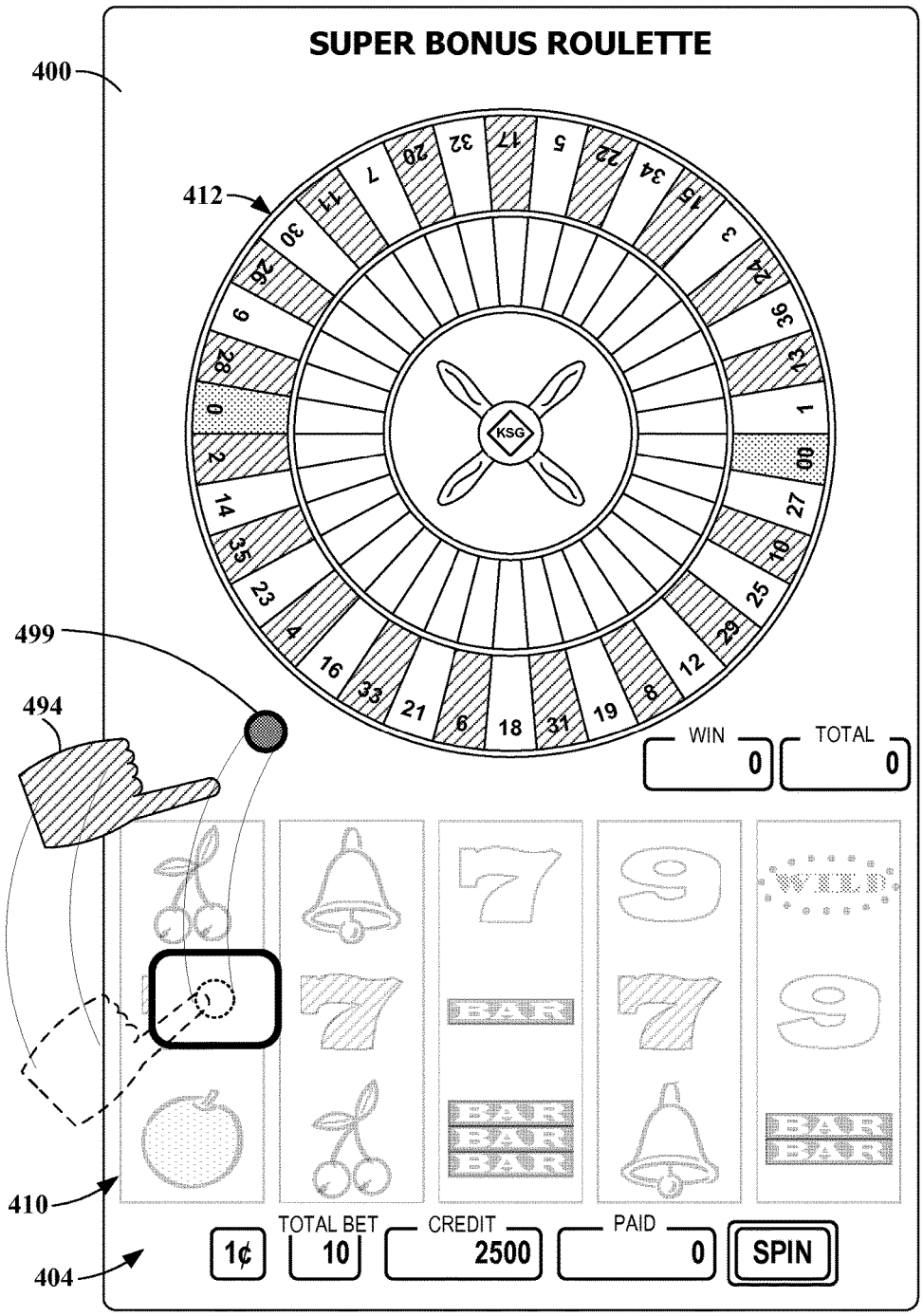

Referring to FIG. 4A, a gaming display 400 includes a game play area 410 and a status and control portion 404. Here, a base or primary game utilizing video game reels is shown in the game play portion 410. Here, a bonus game has been triggered during play of the gaming device. As shown in FIG. 4B, a bonus wheel 412 is displayed on the gaming display 400 and a bonus icon 490 is positioned below the bonus wheel. Here, a player may activate the icon 490 by touching and dragging his or her finger in one direction or another utilizing a touchscreen feature of the gaming display 400. In FIG. 4C, a player 494 touches the icon 490 to bring up a feature-selection screen 495, as shown in FIG. 4D. Here, the features 498 that a player can select in the feature-selection screen 495 include types or styles of a ball used as the icon 490 for a subsequent roll into the bonus wheel 412. In this instance, the player selects a desired appearance feature 499 for the icon ball 490 as shown in FIG. 4E. The features of the icon 499 are then updated to reflect the selected features, as shown in FIG. 4F. Here, the icon 499 is now shown with the selected appearance feature. In FIG. 4G, the player 494 swipes, or otherwise moves the icon 499 about the display 400 to activate it for marking a section of the bonus wheel 412.

Figure 5:
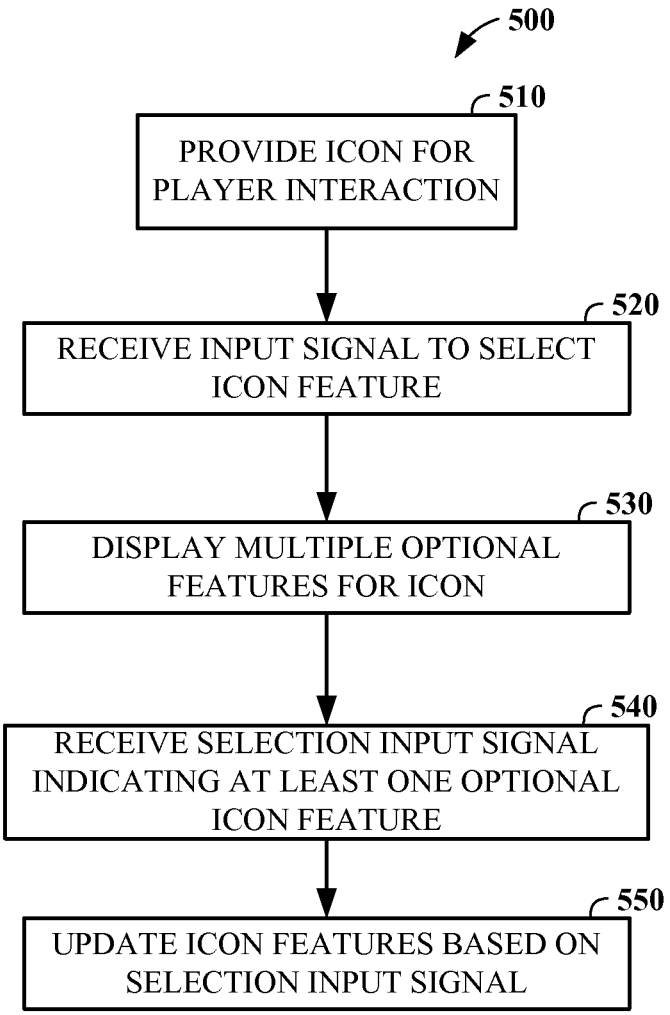
FIG. 5 is a flow diagram showing a method of selecting an icon feature according to embodiments of the invention.
Figure 6:
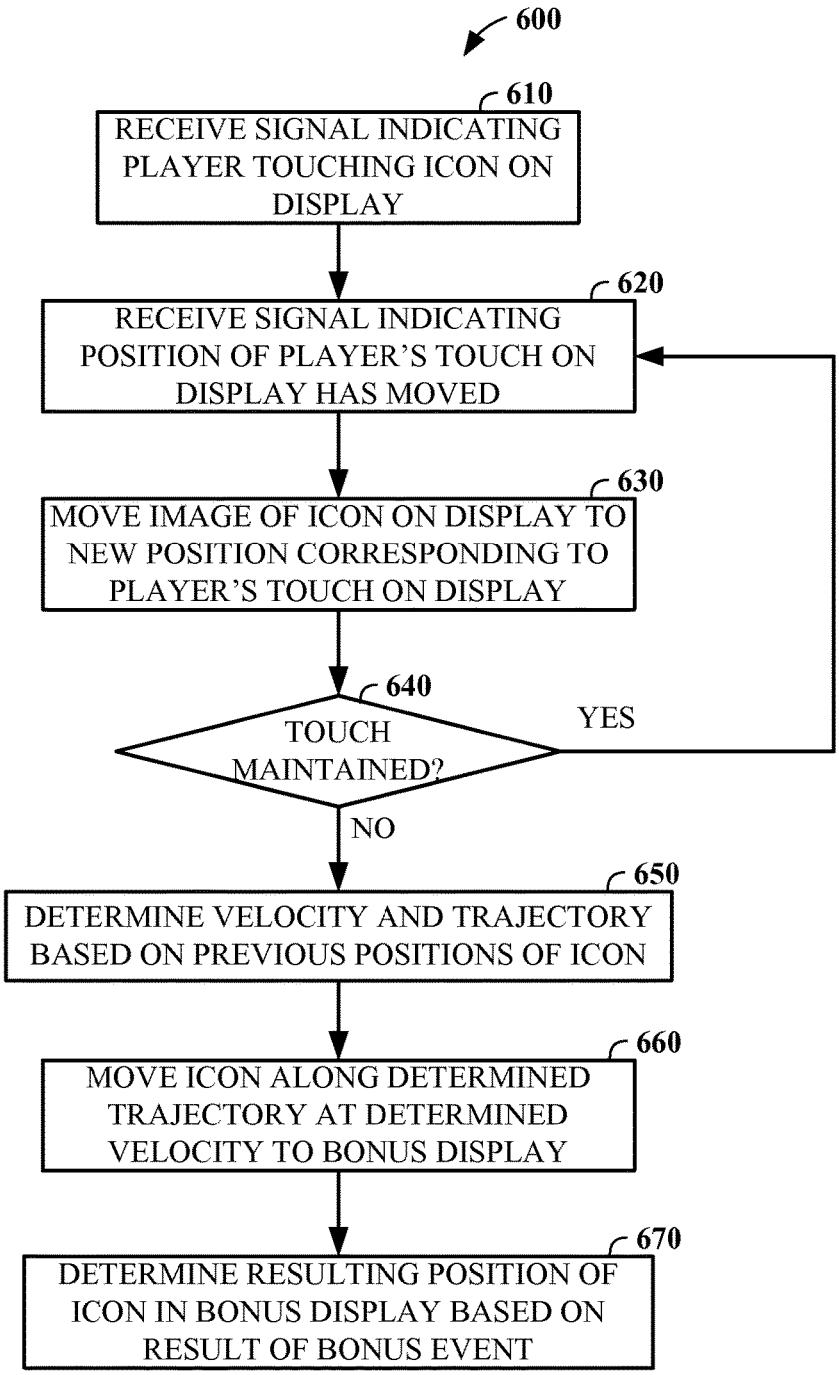
FIG. 6 is a flow diagram showing a method of activating an icon according to embodiments of the invention.

FIGS. 5 and 6 are flow diagrams showing various methods of operating a gaming device to implement embodiments of the invention. Although various processes are shown in a particular order in this flow diagram, the order of these processes can be changed in other embodiments without deviating from the scope or spirit of this concept. Hence, the order of the processes shown is for illustrative purposes only and is not meant to be restrictive. Additional game processes may also be included between various processes even though they are omitted from these flow diagrams for clarity purposes. Further, each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that this example method is just one embodiment of how a game operation can be implemented. As discussed and shown above, many variations exist which may require additional, fewer, or different processes to complete.

FIG. 5 is a flow diagram showing a method of selecting an icon feature according to embodiments of the invention. Referring to FIG. 5, a flow 500 begins at process 510 where an icon is provided for player interaction. In process 520, an input signal is received to select an icon feature. As discussed above, this input signal may result from a player briefly touching the icon, or may result from another type of player interface interaction. In process 530, multiple possible features for the icon are displayed. This process 530 may include using one or more feature-selection screens or displays showing multiple possible features for the icon. In process 540, a selection input signal is received indicating at least one optional icon feature. In some embodiments, the player may select a single feature to implement on the icon. However, in other embodiments, the player may be able to select multiple features to implement on the icon. In process 550, the icon features are updated based on the selection input signal.

FIG. 6 is a flow diagram showing a method of activating an icon according to embodiments of the invention. Referring to FIG. 6, a flow 600 begins at process 610 where a signal is received indicating that a player is touching an interactive icon on a display. In process 620, a signal is received indicating that the position of the player's touch on the display has moved. Flow 600 then proceeds to process 630, where the image of icon on the display is moved to a new position corresponding to the location of the player's touch on the display. In process 640 it is determined if the player's touch is maintained. That is, it is determined in process 640 whether the player remains in contact (touch) with the display, or has removed his or her finger (or other touching part of the player) from the display. If the player has remained in contact with the display, the flow 600 returns to process 620 to await another player movement. If the player has not maintained contact with the display (i.e., the player is no longer touching the display), flow 600 proceeds to process 650.

In process 650, a velocity and trajectory is determined based on the previous positions of the icon. This determination may take into account one or more of the speed, angle, length of touch, length of time in a given position, direction between the last two or more positions of the icon, etc. to determine the trajectory the icon will take at a determined velocity. The velocity may include both the speed of the icon and direction of travel for the icon, which may collectively be captured in one or more mathematical vectors. The trajectory may include the path that the icon takes based on the velocity and other perceived or applied forces, such as drag, gravity, magnetic field, etc. In process 660, the icon is moved along the determined trajectory at the determined velocity to a bonus display. Note that in instances where the initial velocity direction is away from the bonus display, the icon may bounce or rebound off boundary walls implemented in the display. The icon may continue to bounce or rebound following the vectors associated with the determined trajectory until the icon reaches the bonus display. In process 670, the resulting position of the icon in the bonus display is determined based on a result of a bonus event. For example, a resulting section of a bonus wheel in a bonus display may be determined prior to the icon landing on that resulting section of the bonus wheel. In these instances, process 670 may include determining this resulting bonus wheel section and guiding the icon so that is lands on the selected resulting bonus wheel section. In other embodiments, the determined trajectory and/or velocity may at least partially influence the determination of the resulting bonus wheel section. This influence may be related to the speed of the icon defined by the velocity, to the direction of the icon when released, to the timing of the release of the icon related to the bonus features in the bonus display (such as what position the bonus wheel is in when the icon is released), or to other factors related to the trajectory.

Figure 7:
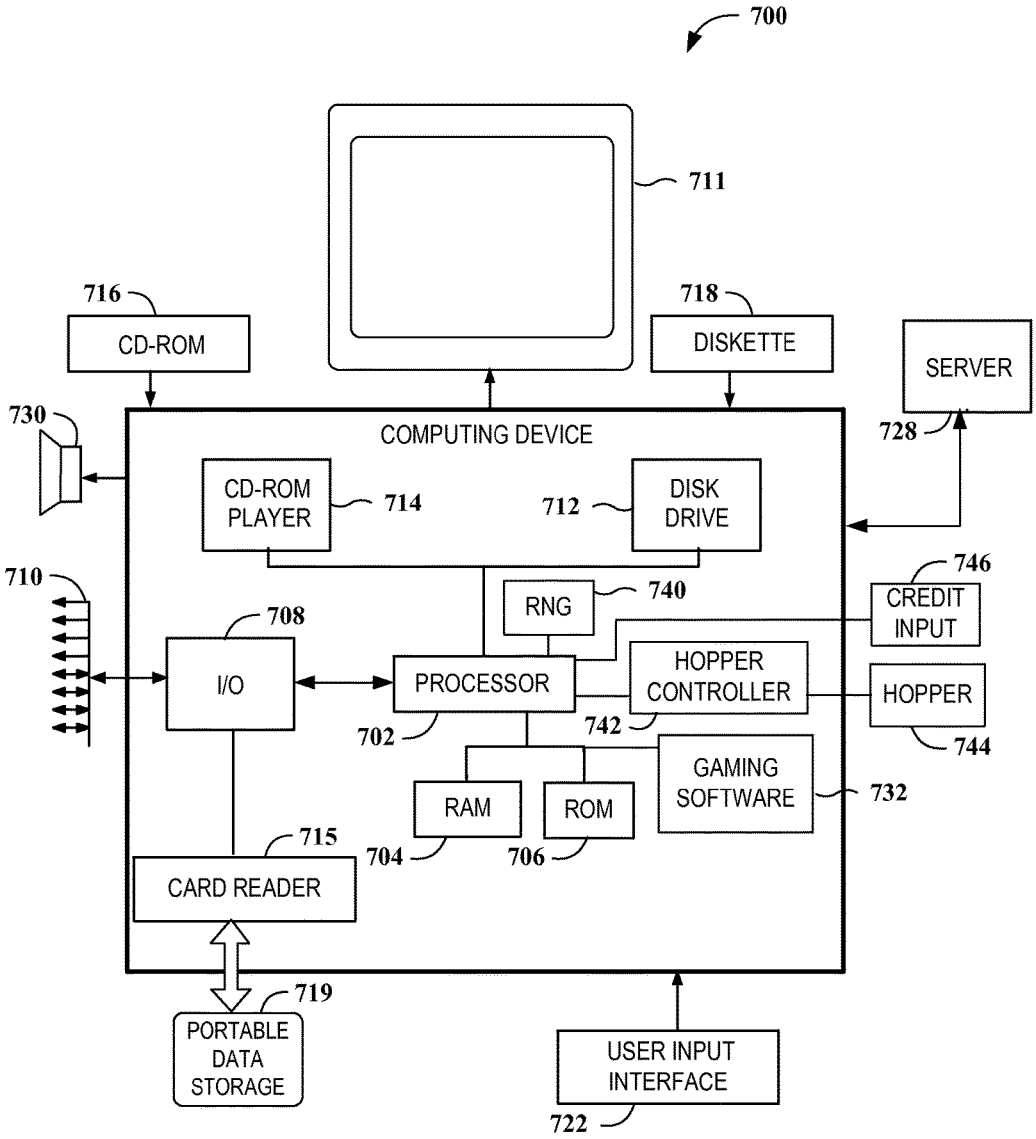
FIG. 7 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 7.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 700 of FIG. 7 is an example computing structure that can be used in connection with such electronic gaming machines, computers, or other computer-implemented devices to carry out operations of the present invention.

The example computing arrangement 700 suitable for performing the gaming functions in accordance with the present invention typically includes a central processor (CPU) 702 coupled to random access memory (RAM) 704 and some variation of read-only memory (ROM) 706. The ROM 706 may also represent other types of storage media to store programs, such as programmable ROM (PROM), erasable PROM (EPROM), etc. The processor 702 may communicate with other internal and external components through input/output (I/O) circuitry 708 and bussing 710, to provide control signals, communication signals, and the like.

The computing arrangement 700 may also include one or more data storage devices, including hard and floppy disk drives 712, CD-ROM drives 714, card reader 715, and other hardware capable of reading and/or storing information such as DVD, etc. In one embodiment, software for carrying out the operations in accordance with the present invention may be stored and distributed on a CD-ROM 716, diskette 718, access card 719, or other form of computer readable media capable of portably storing information. These storage media may be inserted into, and read by, devices such as the CD-ROM drive 714, the disk drive 712, card reader 715, etc. The software may also be transmitted to the computing arrangement 700 via data signals, such as being downloaded electronically via a network, such as the Internet. Further, as previously described, the software for carrying out the functions associated with the present invention may alternatively be stored in internal memory/storage of the computing device 700, such as in the ROM 706.

The computing arrangement 700 is coupled to the display 711, which represents a display on which the gaming activities in accordance with the invention are presented. The display 711 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 700 represents a stand-alone or networked computer, the display 711 may represent a standard computer terminal or display capable of displaying multiple windows, frames, etc. Where the computing device is embedded within an electronic gaming machine, the display 711 corresponds to the display screen of the gaming machine/kiosk. A user input interface 722 such as a mouse, keyboard/keypad, microphone, touch pad, trackball, joystick, touch screen, voice-recognition system, etc. may be provided. The display 711 may also act as a user input device, e.g., where the display 711 is a touchscreen device.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 702, or some combination of hardware and software. The present invention is operable using any known RNG, and may be integrally programmed as part of the processor 702 operation, or alternatively may be a separate RNG controller 740.

The computing arrangement 700 may be connected to other computing devices or gaming machines, such as via a network. The computing arrangement 700 may be connected to a network server 728 in an intranet or local network configuration. The computer may further be part of a larger network configuration as in a global area network (GAN) such as the Internet. In such a case, the computer may have access to one or more web servers via the Internet. In other arrangements, the computing arrangement 700 may be configured as an Internet server and software for carrying out the operations in accordance with the present invention may interact with the player via one or more networks.

Other components directed to gaming machine implementations include manners of gaming participant payment, and gaming machine payout. For example, a gaming machine including the computing arrangement 700 may also include a hopper controller 742 to determine the amount of payout to be provided to the participant. The hopper controller may be integrally implemented with the processor 702, or alternatively as a separate hopper controller 742. A hopper 744 may also be provided in gaming machine embodiments, where the hopper serves as the mechanism holding the coins/tokens of the machine. The wager input module 746 represents any mechanism for accepting coins, tokens, coupons, bills, electronic fund transfer (EFT), tickets, credit cards, smart cards, membership cards, etc., for which a participant inputs a wager amount. It will be appreciated that the primary gaming software 732 may be able to control payouts via the hopper 744 and controller 742 for independently determined payout events.

Among other functions, the computing arrangement 700 provides an interactive experience to players via input interface 722 and output devices, such as the display 711, speaker 730, etc. These experiences are generally controlled by gaming software 732 that controls a primary gaming activity of the computing arrangement 700. The gaming software 732 may be temporarily loaded into RAM 704, and may be stored locally using any combination of ROM 706, drives 712, media player 714, or other computer-readable storage media known in the art. The primary gaming software 732 may also be accessed remotely, such as via the server 728 or the Internet.

The primary gaming software 732 in the computing arrangement 700 is shown here as an application software module. According to embodiments of the present invention, this software 732 provides a slot game or similar game of chance as described hereinabove. For example, the software 732 may present, by way of the display 711, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 732 may include instructions to provide other functionality as known in the art and described herein, such as shown and described above regarding FIGS. 1-6.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a display including a video screen having a game play grid;

a player interface including at least one button, the button configured to generate a signal in response to being activated;

a wager input device structured to identify and validate currency or currency based tickets;

secured circuitry operable to generate random numbers; and game circuitry operable to:

receive a primary game initiation signal, determine an outcome for a primary gaming event, display the determined primary game outcome in the game play grid of the display, evaluate the determined primary game outcome to identify winning symbol combinations, determine if a bonus trigger criterion has been satisfied, display a bonus play area on the display and a bonus icon, wherein the bonus play area includes a bonus wheel having a plurality of sections, and wherein the displayed bonus icon is a ball icon, receive a signal indicating a player input to change a feature of the bonus icon, in response to receiving the signal indicating the player input, display a feature-selection screen on the display including a plurality of selectable features for the bonus icon, where each of the selectable features changes a characteristic of the ball icon, receive a signal indicating selection of a new feature from the feature-selection screen, update the bonus icon with the new feature indicated by the received feature-indicating selection signal, where the ball icon includes a new characteristic associated with the selected new feature from the feature-selection screen, initiate a bonus event where the bonus icon is displayed moving to a randomly selected one of the plurality of sections on the bonus wheel.

2. The gaming device of claim 1, wherein the display includes a touchscreen area covering at least a portion of the video screen.

3. The gaming device of claim 2, wherein the operation of the game circuitry to receive a signal indicating selection of a feature for the bonus icon includes receiving a signal in response to an input received on the touchscreen in an area of the display showing the bonus icon.

4. The gaming device of claim 1, wherein the plurality of selectable features for the bonus icon displayed on the feature-selection screen include a size feature for the icon.

5. The gaming device of claim 1, wherein the plurality of selectable features for the bonus icon displayed on the feature-selection screen include a color feature for the icon.

6. The gaming device of claim 1, wherein the plurality of selectable features for the bonus icon displayed on the feature-selection screen include an appearance theme feature for the icon.

7. The gaming device of claim 1, wherein the plurality of selectable features for the bonus icon displayed on the feature-selection screen include a sound feature for the icon.

8. The gaming device of claim 1, wherein the game circuitry is operable to receive multiple signals respectively indicating multiple new features for the bonus icon.

9. The gaming device of claim 1, wherein the displayed bonus play area includes a virtual roulette wheel.

10. A gaming system connected to a game display operable to display a game play grid, and a player interface operable to receive player inputs, the gaming system including circuitry operable to perform processes comprising:

receiving a primary game initiation signal;

determining an outcome for a primary gaming event;

transmitting a signal to the game display to display the determined primary game outcome in the game play grid of the game display;

evaluating the determined primary game outcome to identify winning symbol combinations;

determining if a bonus trigger criterion has been satisfied;

transmitting a signal to the game display to display a bonus play area and a bonus icon, wherein the bonus play area includes a bonus wheel having a plurality of sections, and wherein the displayed bonus icon is a ball icon;

receiving a signal indicating a player input to change a feature of the bonus icon;

in response to receiving the signal indicating the player input, transmitting a signal to the game display to display a feature-selection screen including a plurality of selectable features for the bonus icon, where each of the selectable features changes a characteristic of the ball icon;

receiving a signal indicating selection of a new feature from the feature-selection screen;

transmitting a signal to the game display to update the bonus icon with the feature indicated by the received feature-indicating selection signal, where the ball icon includes a new characteristic associated with the selected new feature from the feature-selection screen; and initiating a bonus event where the bonus icon is displayed moving to a randomly selected one of the plurality of sections on the bonus wheel.

11. The gaming system of claim 10, wherein the game display includes a touchscreen area covering at least a portion of the game display.

12. The gaming system of claim 11, wherein receiving a signal indicating selection of a feature for the bonus icon includes receiving a signal in response to an input received on the touchscreen in an area of the game display showing the bonus icon.

13. The gaming system of claim 10, wherein the plurality of selectable features for the bonus icon displayed on the feature-selection screen include a size feature for the icon.

14. The gaming system of claim 10, wherein the plurality of selectable features for the bonus icon displayed on the feature-selection screen include a color feature for the icon.

15. The gaming system of claim 10, wherein the plurality of selectable features for the bonus icon displayed on the feature-selection screen include an appearance theme feature for the icon.

16. The gaming system of claim 10, wherein the plurality of selectable features for the bonus icon displayed on the feature-selection screen include a sound feature for the icon.

17. The gaming system of claim 10, wherein the circuitry is operable to receive multiple signals respectively indicating multiple new features for the bonus icon.

18. The gaming system of claim 10, wherein the displayed bonus play area includes a virtual roulette wheel.

* * * * *